US010538374B2

(12) United States Patent
Hayter et al.

(10) Patent No.: US 10,538,374 B2
(45) Date of Patent: Jan. 21, 2020

(54) OFFSET BLANK NESTING

(71) Applicant: WestRock Packaging Systems, LLC, Norcross, GA (US)

(72) Inventors: Gregory P. Hayter, Atlanta, GA (US); James M. Cantrell, Valley, AL (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 51 days.

(21) Appl. No.: 15/556,125

(22) PCT Filed: Mar. 7, 2016

(86) PCT No.: PCT/US2016/021117
§ 371 (c)(1),
(2) Date: Sep. 6, 2017

(87) PCT Pub. No.: WO2016/144845
PCT Pub. Date: Sep. 15, 2016

(65) Prior Publication Data

US 2018/0044085 A1 Feb. 15, 2018

Related U.S. Application Data

(60) Provisional application No. 62/129,106, filed on Mar. 6, 2015.

(51) Int. Cl.
*B65D 71/58* (2006.01)
*B31B 50/16* (2017.01)
(Continued)

(52) U.S. Cl.
CPC ..... *B65D 71/0022* (2013.01); *B31B 50/14* (2017.08); *B31B 50/142* (2017.08);
(Continued)

(58) Field of Classification Search
CPC ..... B65D 71/0022; B31B 50/16; B31B 50/20; B31B 50/14; B31B 50/142
(Continued)

(56) References Cited

U.S. PATENT DOCUMENTS 3,084,831 A * 4/1963 Arneson ..... B65D 71/0022 206/187
3,140,797 A * 7/1964 Arneson ..... B65D 71/0022 206/173
(Continued)

FOREIGN PATENT DOCUMENTS

DE 10328495 A1 3/2004
EP 0693020 B1 1/1996

*Primary Examiner* — Christopher R Demeree
(74) *Attorney, Agent, or Firm* — WestRock Intellectual Property Group

(57) ABSTRACT

A method of forming a packaging blank includes stripping away a portion of a stock material to create an offset void (24, 25) and blanking the stock material into a plurality of packaging blanks. Blanking includes separating the stock material along a plurality of severance lines (26, 28, 29) dividing between the blanks (100), wherein at least two of the severance lines are separated from one another by the offset void. Blanking can include separating the stock material along a plurality of severance lines dividing the blanks from one another by a blanking grid, wherein the blanking grid is arranged in a nested sheet-fed layout.

17 Claims, 9 Drawing Sheets

(51) Int. Cl.
*B31B 50/20* (2017.01)
*B31B 50/14* (2017.01)

(52) U.S. Cl.
CPC ..... *B31B 50/16* (2017.08); *B31B 50/20* (2017.08); *B65D 2301/10* (2013.01); *B65D 2571/0045* (2013.01); *B65D 2571/0066* (2013.01); *B65D 2571/00333* (2013.01)

(58) Field of Classification Search
USPC .... 229/120.01, 934, 117.09, 117.14, 120.17; 206/198, 187, 191, 427
See application file for complete search history.

(56) References Cited

U.S. PATENT DOCUMENTS

| | | | | | |
|---|---|---|---|---|---|
| 3,203,585 | A | * | 8/1965 | Wood | B65D 71/0022 206/188 |
| 3,432,073 | A | * | 3/1969 | Forrer | B65D 71/0022 206/188 |
| 3,487,975 | A | * | 1/1970 | Riddell | B65D 71/0022 206/186 |
| 3,917,059 | A | | 11/1975 | Wood | |
| 4,258,844 | A | * | 3/1981 | Stout | B65D 71/0022 206/288 |
| 4,715,847 | A | | 12/1987 | Focke | |
| 5,879,041 | A | | 3/1999 | Sutherland | |
| 2006/0112803 | A1 | | 6/2006 | Vossen | |
| 2008/0269034 | A1 | | 10/2008 | Stier | |

* cited by examiner 208
212
210
214
212
210
214
212
210
214

OFFSET BLANK NESTING

CROSS-REFERENCE TO RELATED APPLICATIONS

This application is a National Phase application of PCT Application PCT/US16/21117, filed Mar. 7, 2016, which claims the benefit of U.S. Provisional Patent Application No. 62/129106, filed Mar. 6, 2015, both of which are incorporated herein by reference in their entirety.

BACKGROUND OF THE INVENTION

1. Field of the Invention

The present disclosure relates to blanks such as used in forming containers, and more particularly to nesting techniques such as used in arranging multiple blanks on a work piece sheet or web of stock material.

2. Description of Related Art

A variety of devices and methods are known in the art for forming packaging blanks from sheets or webs of stock material such as paper board. A variety of packages can be produced from such blanks. During the manufacture of packaging blanks from sheet or web materials, portions of the sheet or web that are not ultimately part of the finished blanks constitute scrap.

Conventional techniques in manufacturing packaging blanks have been considered satisfactory. However, there is an ongoing need for improved methods and devices, such as for reducing the amount of scrap produced during the manufacture of packaging blanks. The present disclosure provides a solution for this need.

SUMMARY OF THE INVENTION

A method of forming a packaging blank includes stripping away a portion of a stock material to create an offset void and blanking the stock material into a plurality of packaging blanks. Blanking includes separating the stock material along a plurality of severance lines dividing between the blanks, wherein at least two of the severance lines are separated from one another by the offset void.

Blanking can include separating the stock material along a plurality of severance lines dividing the blanks from one another along a blanking grid, wherein the blanking grid is arranged in a nested sheet-fed layout. A first one of the severance lines can meet the offset void along a first direction, and a second severance line can be spaced apart from the first severance line, wherein the second severance line meets the offset void along the first direction.

Stripping away a portion of the stock material can include forming a plurality of offset voids, wherein blanking includes separating the stock material along a plurality of severance lines dividing between adjacent nested blanks along a blanking grid, and wherein all of the severance lines extend in a machine direction and/or in a direction perpendicular to the machine direction. It is also contemplated that stripping away a portion of the stock material can include forming a plurality of offset voids, wherein blanking includes separating the stock material along a plurality of severance lines dividing between the blanks along a blanking grid, wherein none of the severance lines are cut to meet at an angle relative to one another without an intervening offset void.

Stripping away a portion of the stock material can include forming an offset void between a riser panel of a first one of the blanks and a second one of the blanks, wherein blanking includes separating the stock material along two severance lines dividing between the first and second blanks, and wherein the two severance lines are spaced apart by the offset void between the riser panel and the second one of the blanks. The two severance lines separating the riser panel and the second one of the blanks can be straight and co-linear with one another. It is also contemplated that stripping away a portion of the stock material can include forming an offset void between two respective bottom panels of two respective blanks, wherein blanking includes separating the stock material along two severance lines, each of the two severance lines respectively dividing between a bottom panel of one of the respective blanks and the other respective blank.

An array of packaging blanks for containers includes a sheet of stock material with nicked cuts defining a plurality of blanks nested in a sheet-fed layout. The blanks are divided from one another at a plurality of severance lines.

In certain embodiments, none of the severance lines meets another severance line at an angle. At least a first one of the severance lines can meet an offset void in the stock material along a first direction, and a second one of the severance lines that is spaced apart from the first one of the severance lines can also meet the offset void along the first direction. All of the severance lines can extend in a machine direction and/or in a direction perpendicular to the machine direction.

Each of the blanks can include a riser panel, wherein two severance lines separate between the riser panel of one of the blanks and another one of the blanks, wherein there is an offset void also separating between the riser panel of the one blank and the other blank that spaces the two severance lines apart from one another. The two severance lines separated across the offset void can be straight and co-linear with one another.

In another aspect, there can be a severance line separating between a bottom panel of a first one of the blanks and a second one of the blanks, and another severance line separating between the first one of the two blanks and a bottom panel of the second one of the two blanks. The severance lines separating between bottom panels and blanks are spaced apart across an offset void offsetting the two bottom panels. This offset void can define a sigmoid shape, for example.

There can be three severance lines separating two respective blanks wherein the three severance lines are angled relative to one another, wherein a middle one of the three severance lines is separated from each of the other two severance lines by a respective offset void in the stock material. The blanks can be connected to one another by nicks along severance lines, wherein at least some of the severance lines are spaced apart from one another across offset voids offsetting between respective blanks, wherein the offset voids are ⅜ inch (0.95 cm) wide.

A blanking die for striking packaging blanks from stock material includes a blanking frame and a blanking grid attached to the blanking frame for separating blanks from one another. The blanking grid conforms to severance lines dividing between a plurality of blanks nested in a sheet-fed layout.

A cutting die for cutting packaging blanks from stock material includes a cutting die base and a plurality of cutting blades mounted to the cutting die base. The cutting blades are arranged to cut an array of packaging blanks nested in a sheet-fed layout as described above. At least some of the cutting blades can define an offset void for cutting an offset void separating between two packaging blanks. The cutting die can include a cutting blade for cutting a first severance line that meets the offset void and another cutting blade for cutting a second severance line that meets the offset void wherein the blades for cutting the first and second severance lines are spaced apart by the cutting blades for cutting the offset void.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
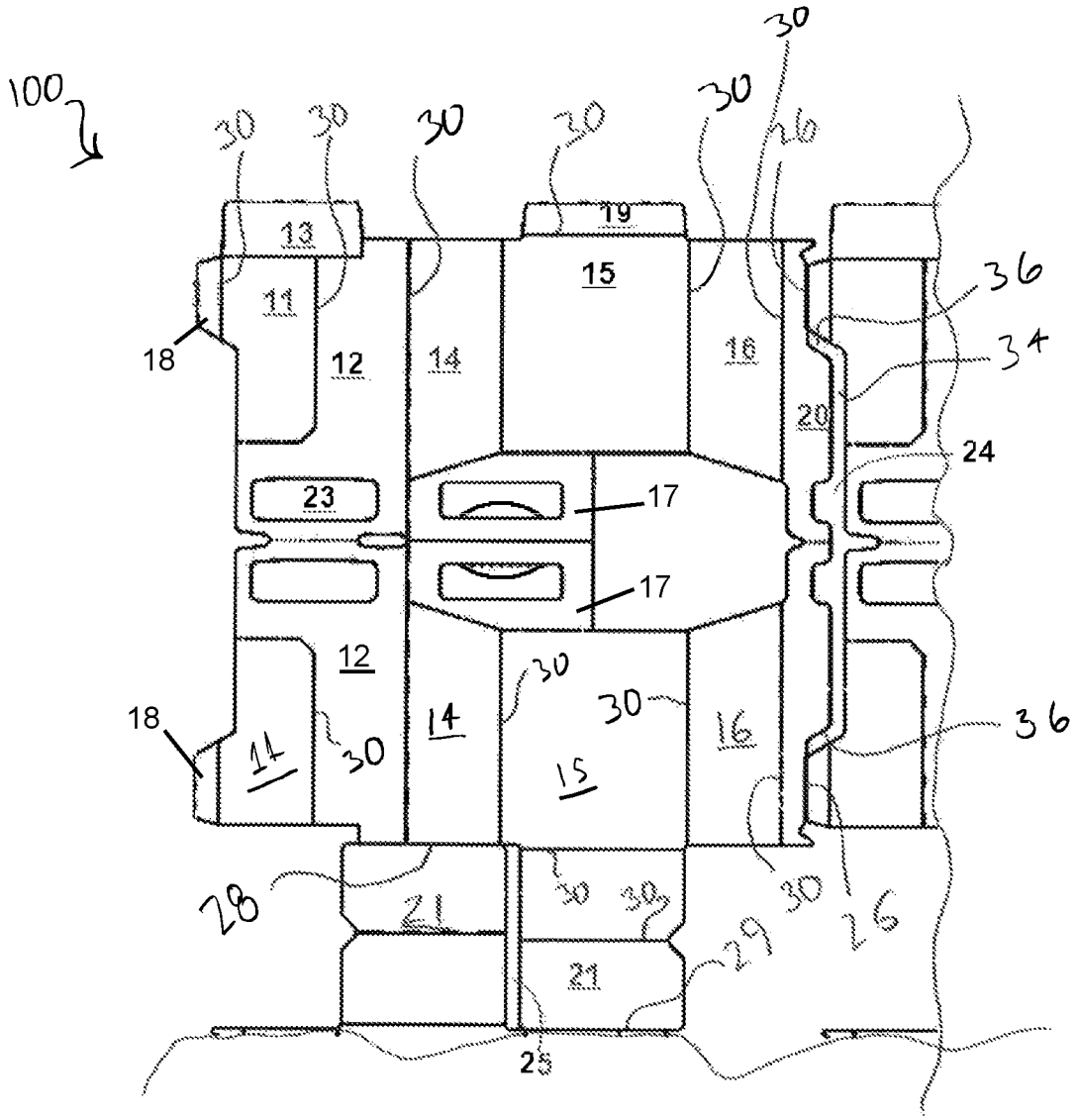
FIG. 1 is a plan view of an exemplary embodiment of a blank constructed in accordance with the present disclosure, showing a blank and portions of neighboring blanks that are nested with the blank.

Reference will now be made to the drawings wherein like reference numerals identify similar structural features or aspects of the subject disclosure. For purposes of explanation and illustration, and not limitation, a partial view of an exemplary embodiment of a blank in accordance with the disclosure is shown in FIG. 1 and is designated generally by reference character 100. Other embodiments of blanks in accordance with the disclosure, or aspects thereof, are provided in FIGS. 2-9, as will be described. The systems and methods described herein can be used to nest blanks in stock material, e.g., in a sheet-fed layout, to reduce scrap.

Packaging blanks can be formed from stock material, e.g., sheets of paperboard, by cutting the stock material to form an array of packing blanks, stripping out voids or holes from the stock material and then using a blanking process to separate individual blanks in the stock material from one another. Graphic material can be printed on one or both sides of the stock material. Ultimately, the individual blanks can be formed into containers or packages with graphical print, for example.

Blank 100 is for a basket type package, e.g., for carrying a plurality of beverage bottles. Blank 100 includes a primary partition panel or medial panel 12, secondary partition panels or lateral partition panels 11, a heel panel or lower partition panel 13, end panels 14, side panels 15 or front/rear panels, end panels 16, a handle panel 17, a glue tab 18, a glue flap 19, a riser panel 20, a bottom panel 21, and a hand opening 23. The lower portion of FIG. 1 shows a portion of another blank identical to blank 100, the bottom panel 21 of which is shown nested with bottom panel 21 of the main blank 100 shown in FIG. 1. An offset void 25 is defined between the two bottom panels. Another offset void 24 is defined between riser panel 20 and another blank identical to blank 100, a portion of which is shown on the right hand portion of FIG. 1.

As described in greater detail below, blank 100 and the adjacent blanks are connected to one another by nicks along severance lines that are cut during a cutting process, and are then separated in a blanking process to separate each blank 100 from adjacent blanks formed from the same sheet of stock material. A pair of severance lines 26 separates between riser panel 20 and the adjacent blank on the right in FIG. 1. Severance line 29 separates between bottom panel 21 of blank 100 and the adjacent blank at the bottom of FIG. 1. Severance line 28 separates between the bottom panel 21 of the lower blank in FIG. 1 and medial and end panels 12 and 14 of blank 100. A plurality of fold lines 30 are formed between the respective panels as indicated in FIG. 1, to facilitate forming blank 100 into a basket type package. U.S. Pat. No. 5,040,672, which is incorporated by reference herein in its entirety, describes a general background on forming blanks into packages or containers.

Figure 2:
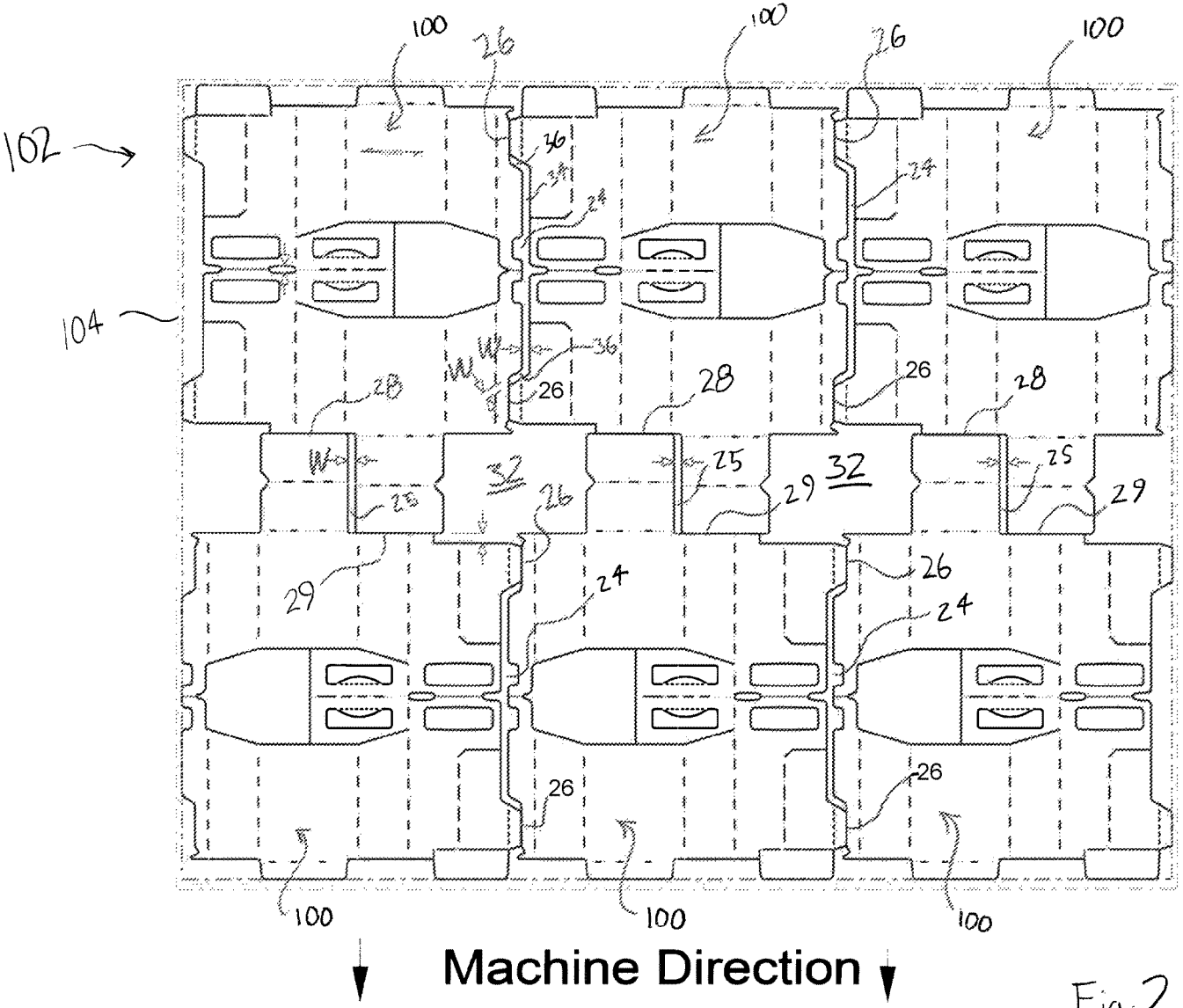
FIG. 2 is a plan view of the blanks of FIG. 1, showing six blanks nested in a two by three array on a single sheet of stock material.

Referring now to FIG. 2, a plurality of blanks 100 for containers as described above can be nested together in an array 102. Array 102 includes a sheet 104 of stock material, e.g., paperboard, with printed matter thereon, e.g., including packaging graphics, defining a plurality of blanks 100 nested in a sheet-fed layout. The nested, sheet-fed layout of blanks 100 allows almost the entire sheet 104 to be used for packaging, and leaves less scrap than if the layout of blanks 100 was not closely nested. The blanks 100 are connected to one another at a plurality of severance lines 26, 28, and 29 wherein none of the severance lines 26, 28, and 29 meets another severance line at an angle.

To facilitate the blanking process, offset voids 24 and 25 are cut and stripped out of sheet 102 prior to blanking. As can be seen in FIG. 2, for the two by three arrays 102 of blanks 100, there are four offset voids 24 and three offset voids 25. Each of the offset voids 24 and 25 spaces two respective severance lines 28 and 29 or 26, 26 apart from one another. For instance, each offset void 24 spaces the respective pair of straight, collinear severance lines 26, 26 apart from one another thereacross. Those severance lines of each pair are aligned with each other in the machine direction shown in FIG. 2. Each offset void 25 similarly spaces apart between the respective pair of severance lines 28 and 29, wherein the respective severance lines 28 and 29 extend in the same direction, but are offset from each other in the machine direction indicated in FIG. 2. All of the severance lines 28, 29, and 26 extend in the machine direction (as are severance lines 26) or in a direction perpendicular to the machine direction, e.g., in the grain direction identified in FIGS. 1 and 2 (as are severance lines 28 and 29). It is also contemplated that severance lines may be formed along any other suitable angle relative to the machine direction or grain direction without departing from the scope of this disclosure. None of the severance lines 28, 29, or 26 that separates between blanks 100 meets another severance line 28, 29, or 26 at an angle without an intervening void, e.g., offset voids 24 and 25, or medial voids 32. Offset void 25 defines a sigmoid shape with pointed ends opening from each respective severance line 28 and 29.

Each of the offset voids 24 and 25 provides an offset width W between two adjacent blanks 100. Those skilled in the art will readily appreciate that width W can be varied from application, but can be ⅜ inch (0.95 cm) wide in paperboard applications, for example. This gap width, and the fact that none of the severance lines 26, 28, or 29 separating between blanks 100 meet each other at an angle, reduces or even eliminates tearing of blanks 100 during the blanking process, which would otherwise occur where two severance lines meet an angle. Offset voids 24 each have a main portion 34 that extends in the machine direction, and include opposed terminus portions 36 that are each angled obliquely relative to the respective main portion 34, to provide angles contours along the corresponding portions of each of the adjacent blanks 100. The main portion 34 is optional, and could be replaced with a severance line connecting between the two terminus portions 36, 36.

An advantage of the array 102 of blanks 100 shown in FIG. 2 is that the edges of the left most two blanks 100 are flush with one another, leaving very little scrap along that edge of the stock material. Moreover, having the blanks 100 flush and nested with one another results in less material used in total, in addition to very little scrap being produced. This is made possible by the bottom panels 21 not being symmetrically centered relative to their respective side panels 15. This asymmetry provides room for the offset voids 25. Making the bottom panels 21 centered on their respective side panels 15 would require more scrap area along the left edge of the stock material in order to provide room for the offset voids 25.

Figure 3:
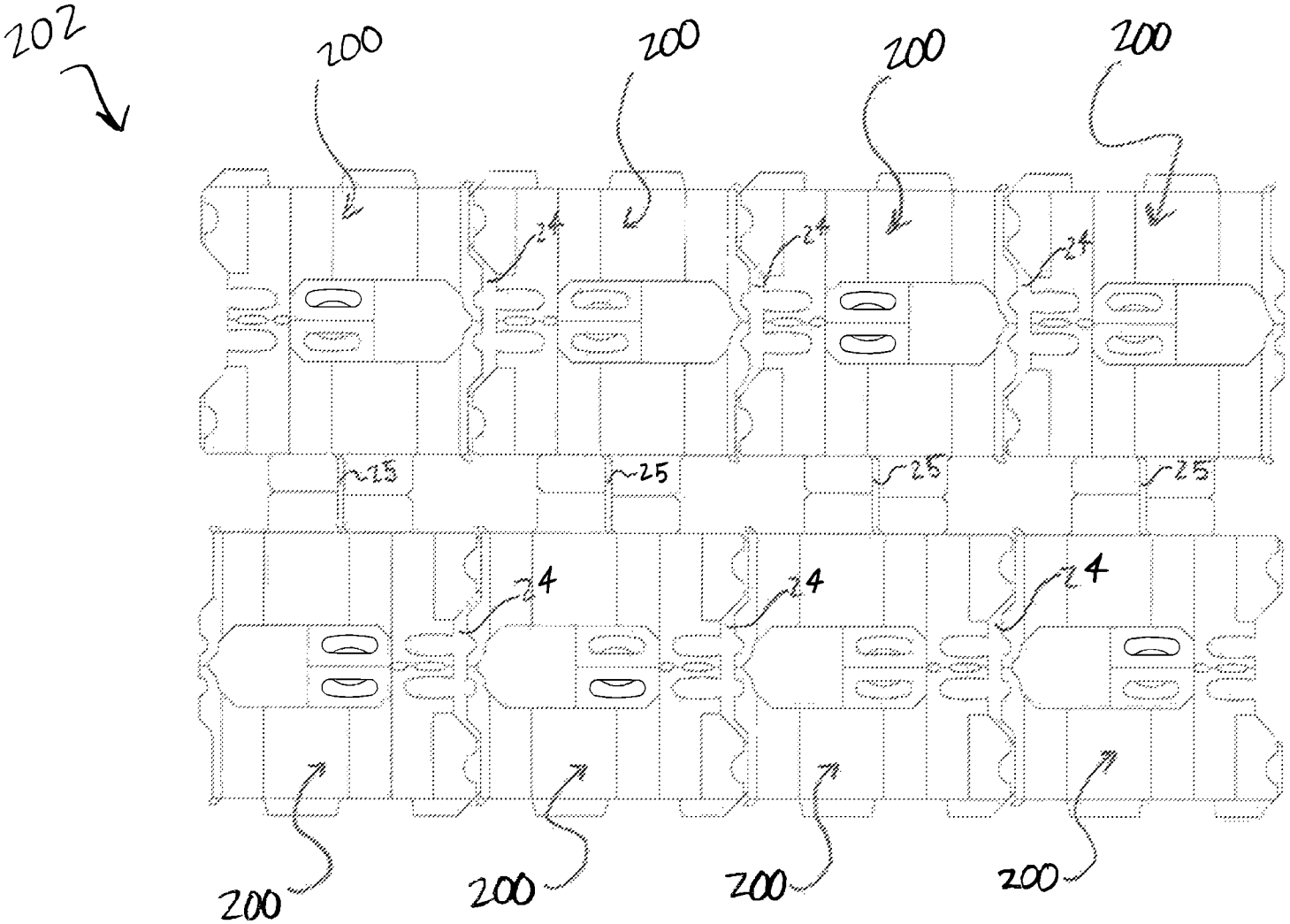
FIG. 3 is a plan view of another exemplary embodiment of a nested array of blanks, showing a two by four array.
Figure 4:
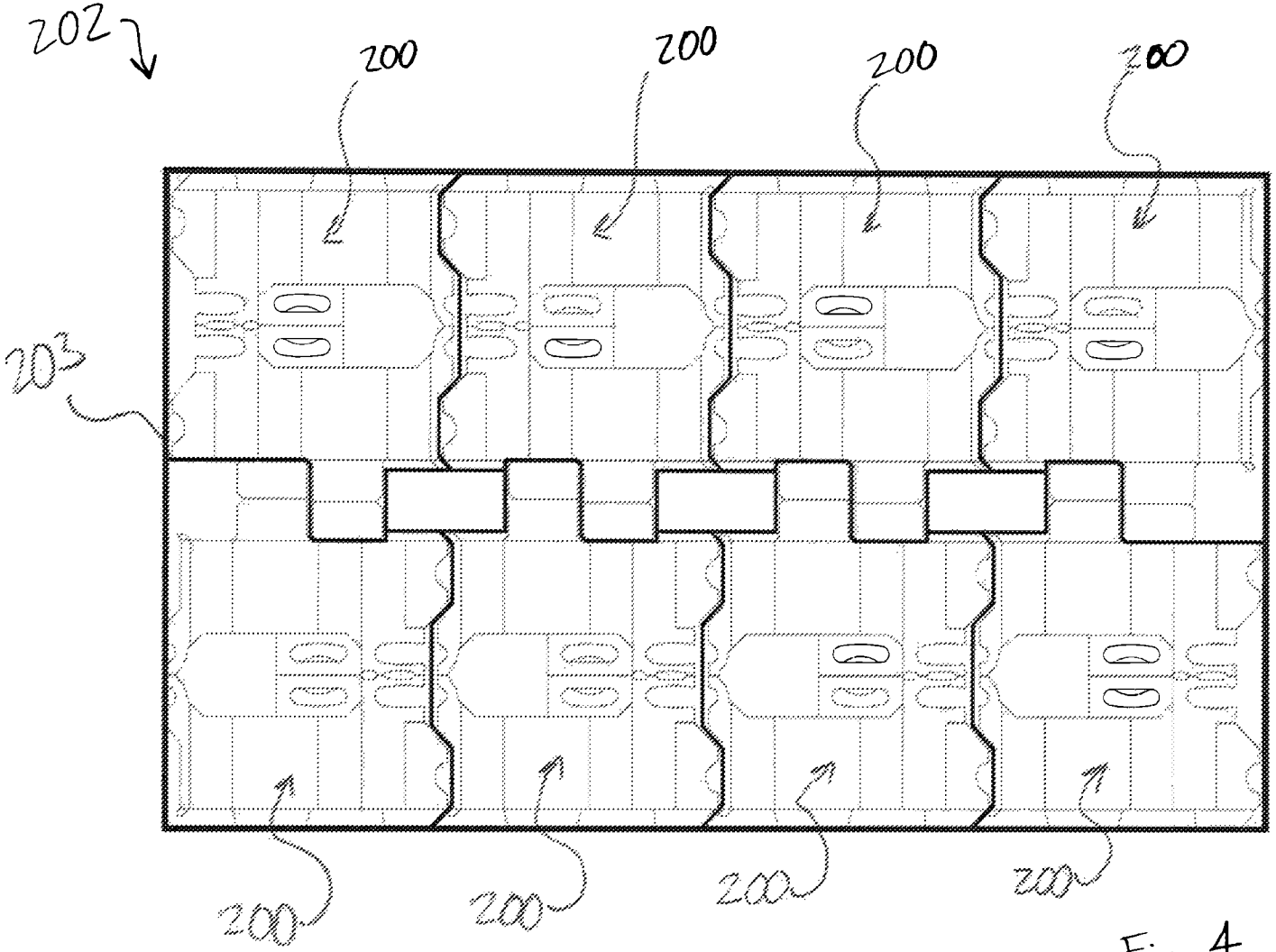
FIG. 4 is a plan view of the blanks of FIG. 3, showing the blanking grid.

With reference now to FIG. 3, another exemplary embodiment of blanks 200 are shown in an array 202, which is a two by four array. Array 202 includes six offset voids 224, similar to offset voids 24 described above, and four offset voids 225, similar to offset voids 25 described above. FIG. 4 shows this same array 202 with a heavy line schematically indicating the corresponding blanking grid 203 superimposed over the eight blanks 200. Blanking grid 203 is part of a blanking die that separates the blanks 200, along the respective offset voids 224 and 225 as well as the severance lines.

Figure 5:
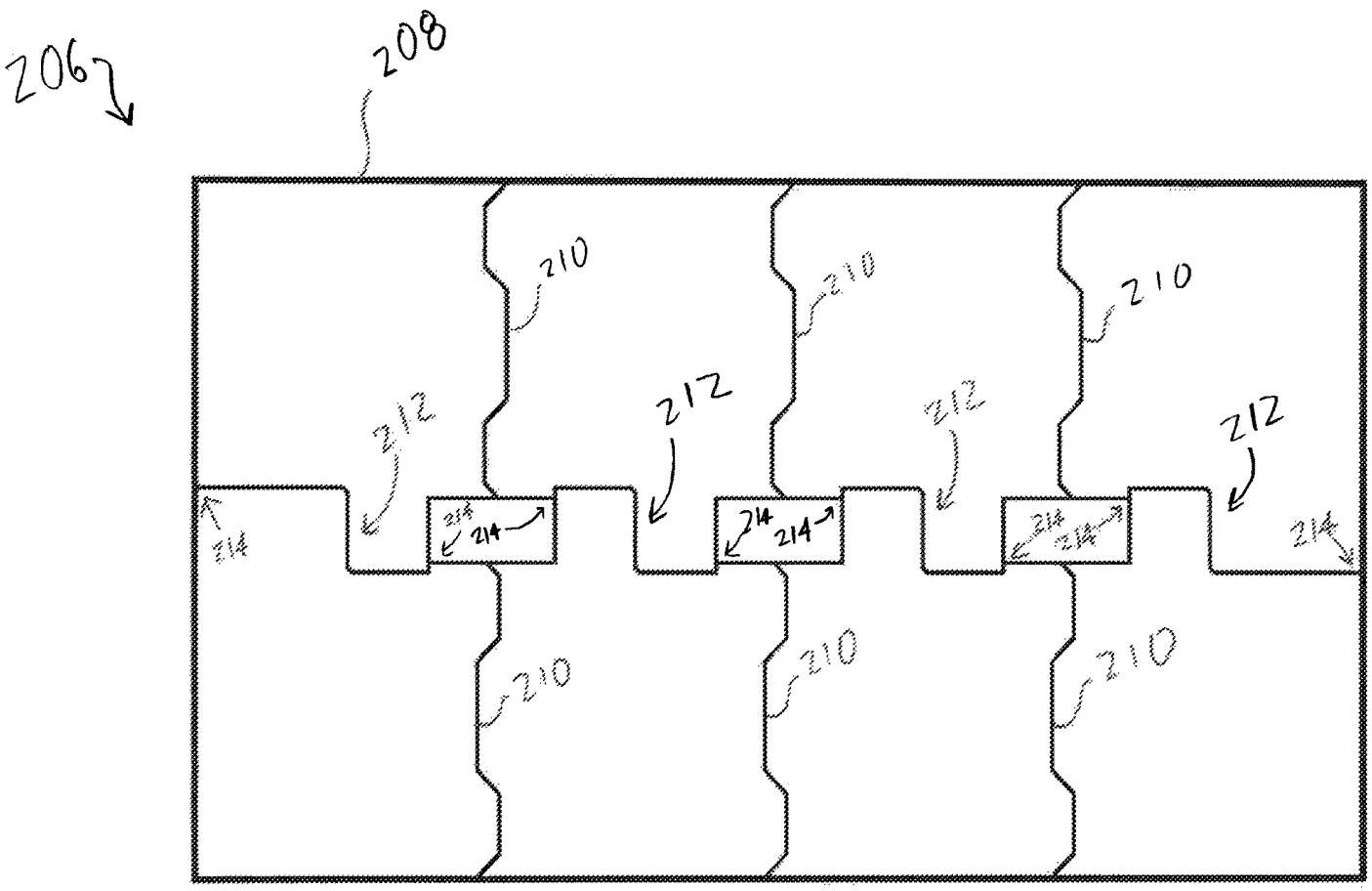
FIG. 5 is a schematic view of an exemplary embodiment of a blanking die, showing the frame and the blanking grid of FIG. 4.

With reference to FIG. 5, a blanking die 206 is shown schematically, which includes the blanking grid 203 of FIG. 4. Blanking die 206 can be used for striking packaging blanks, e.g., blanks 200, from stock material. Blanking die 206 includes a blanking frame 208 and the blanking grid 203, which is attached to the blanking frame 208 for separating the individual blanks from one another. A die cut sheet of stock material wherein individual blanks are connected to the stock material by nicks, can be positioned on blanking die 206. A corresponding male die drives individual blanks through blanking grid 203, separating the blanks from one another as they bass through blanking grid 203. Separating bars 210 of blanking grid 203 are positioned to separate blanks 200, along offset voids 224 and the severance lines contiguous therewith, e.g., severance lines 26 described above. Medial separating bars 212, each of which extends between a respective pair of end points 214, separate blanks along offset voids 225 and the severance lines contiguous therewith, e.g., severance lines 28 and 29 described above.

Figure 6:
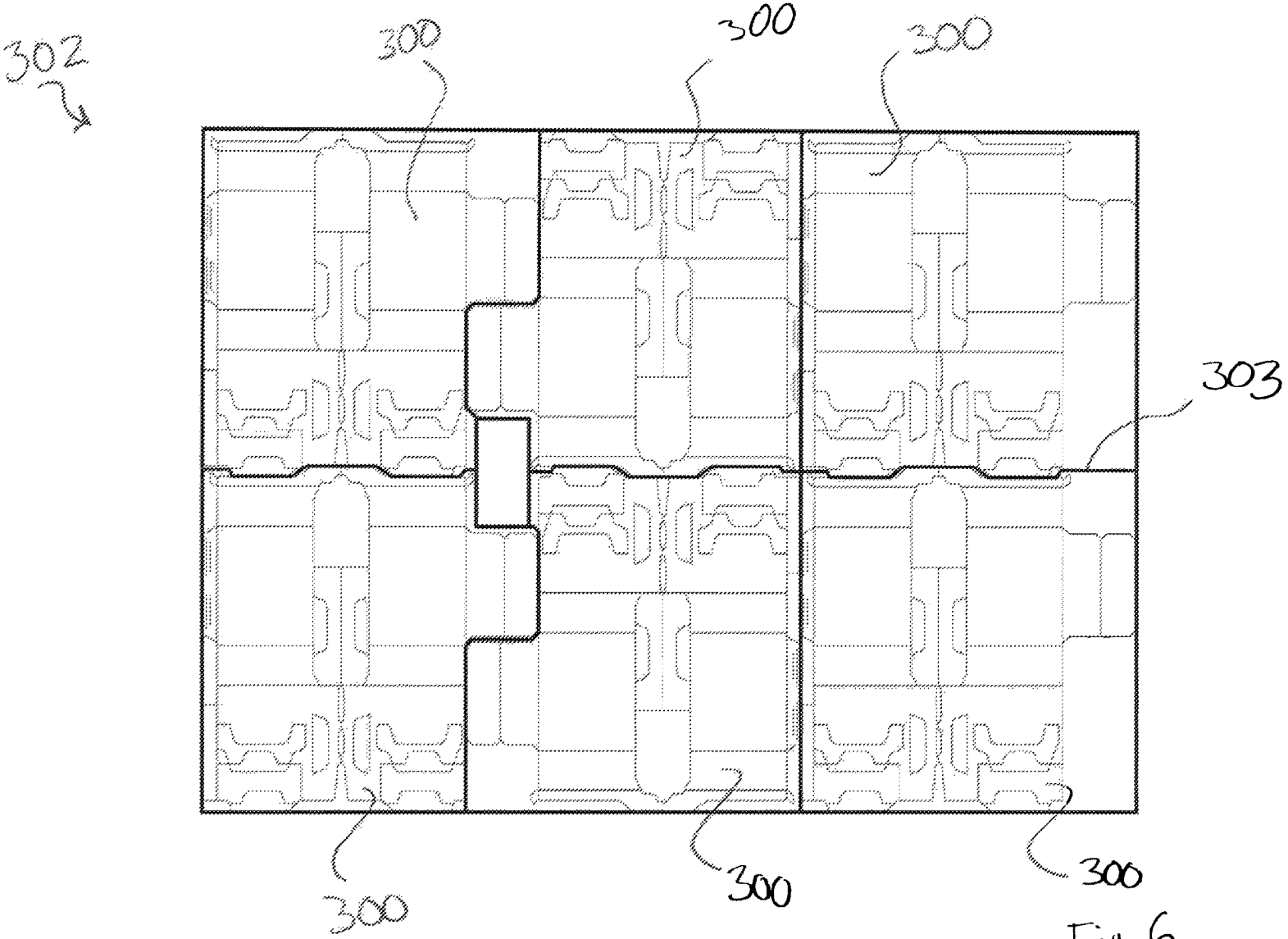
FIG. 6 is a plan view of another exemplary embodiment of a nested array of blanks, showing the corresponding blanking grid.

As can be seen by comparison of FIGS. 3, 4, and 5, anywhere two straight grid portions meet or intersect each other at an angle, there is provided a void between two adjacent blanks at the intersection or meeting point so that a substantial length of either straight grid portion does not strike the stock material at that meeting point or intersection during the blanking process. The blanking grid can be adapted as needed to suit any specific blank design. FIG. 6 shows another example of a nested array 302 of blanks 300 and the corresponding blanking grid 303.

Figure 7:
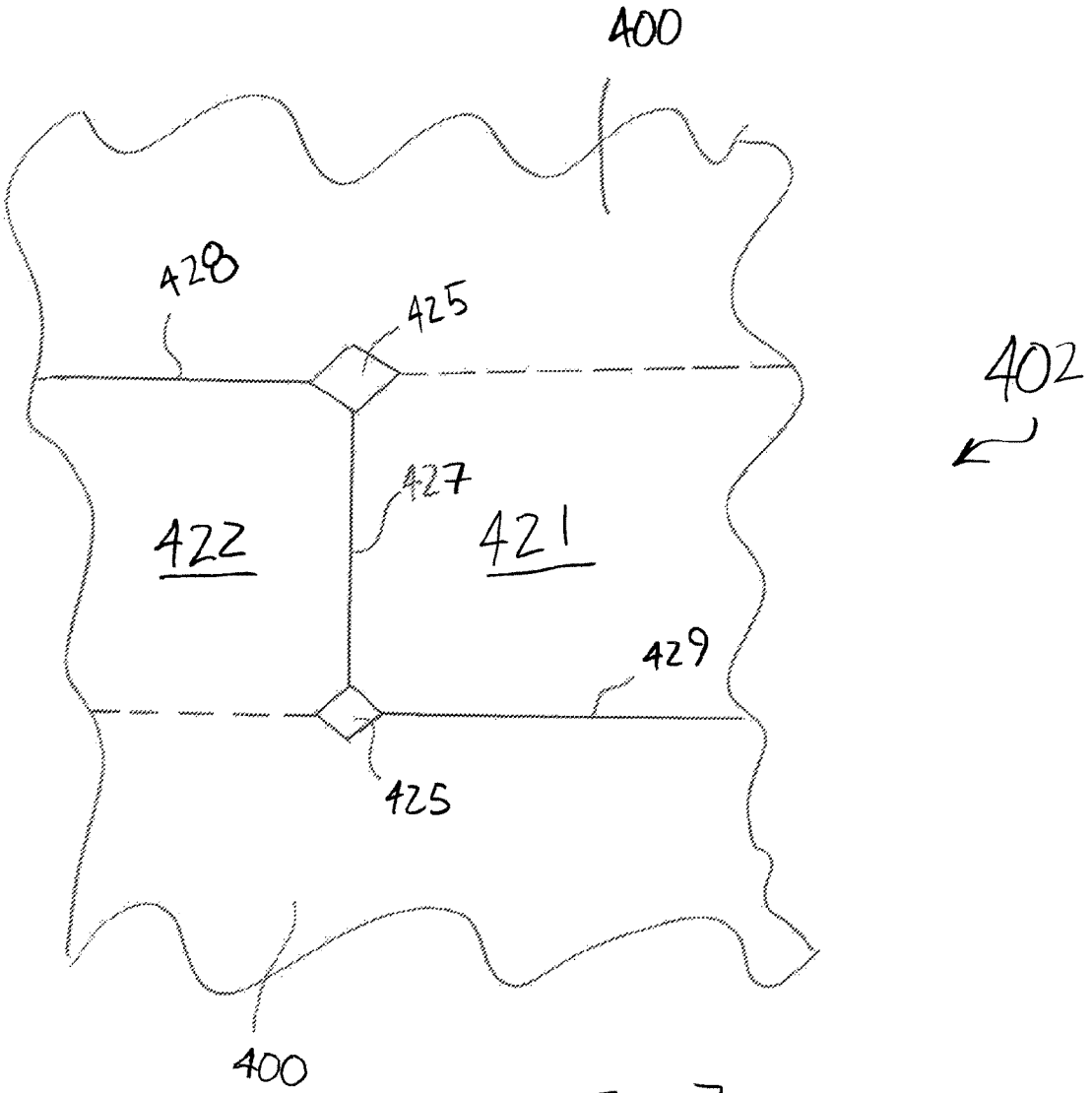
FIG. 7 is a plan view of a portion of another exemplary embodiment of a nested array of blanks, showing a middle severance line angled with respect to two other severance lines, wherein a respective intervening void is provided between the middle severance line and the other two.

Referring now to FIG. 7, it is also contemplated that tearing at corners formed by severance lines can be reduced or avoided by stripping out area adjacent to the angle or intersection where two severance lines meet. In FIG. 7, a portion of an array 402 of nested blanks 400 includes two nested end panels 421 and 422. Instead of having a single offset void separating end panels 421 and 422, such as offset void 25 in FIG. 1, a middle severance line 427 is provided, with an offset void 425 formed at either end thereof. Offset voids 425 connect with severance lines 428 and 429 so that severance line 427 is separated from each of the other severance lines 428 and 429 by a respective offset void 425. Severance line 427 is oriented at an angle relative to the other two severance lines 428 and 429, but none of the severance lines meets another at a corner where tearing could be caused during blanking.

Figure 8:
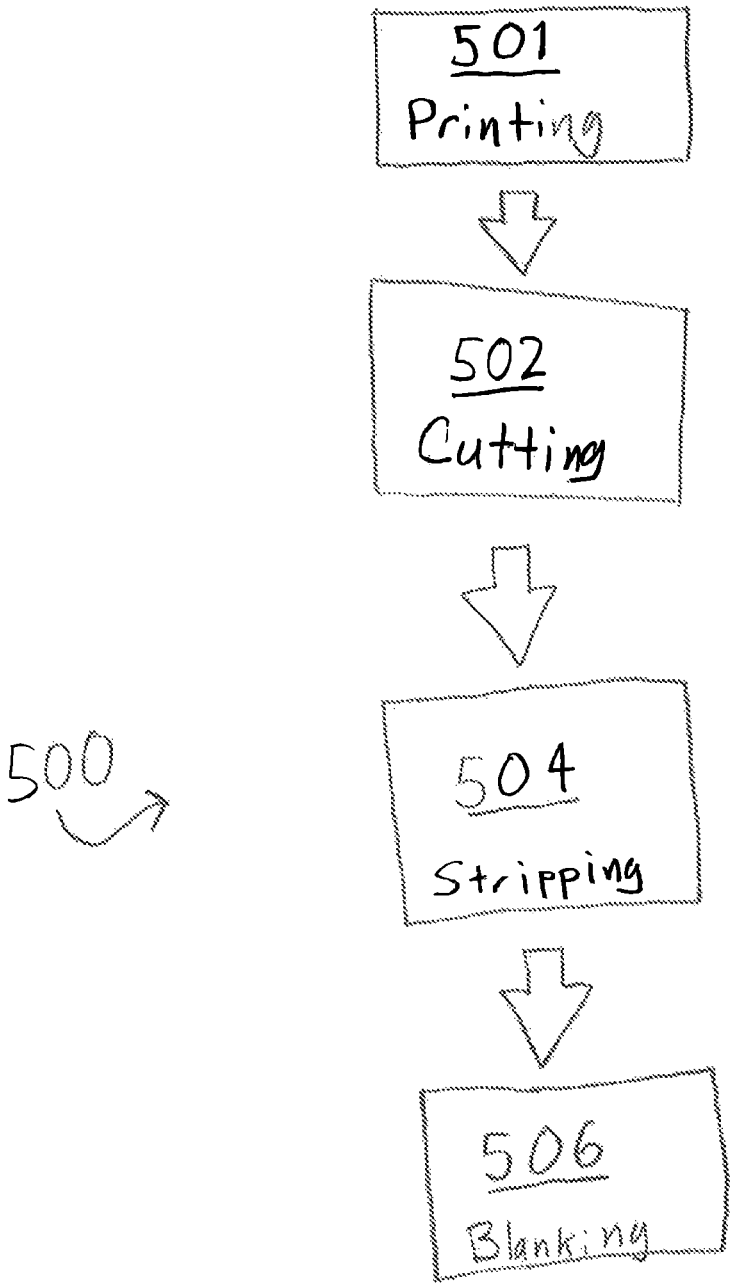
FIG. 8 is a schematic view of an exemplary method in accordance with this disclosure.

Referring now to FIG. 8, a method 500 of forming packaging blanks includes optionally printing graphics onto a sheet of stock material such as paperboard, as indicated by reference character 501. The sheet of material is then cut using a cutting die, an example of which is described below, as indicated by reference character 502 in FIG. 8. The cutting die forms fold lines by scoring, forms perforations with perforation blades, and cuts along cut lines such as the severance lines described herein. The cut lines are not cut completely, but instead leave behind small nicks connecting across the cut lines. Method 500 also includes stripping away a portion or portions of the stock material, as indicated by reference character 504. This removes material corresponding to negative space between and around the array of blanks, but still leaves the blanks themselves connected at nicks left in the cutting 502. This can include stripping away portions of the stock material to form offset voids, such as offset voids 24 and 25, along cut lines that define the offset voids in during cutting 502. The method also includes blanking the stock material into a plurality of packaging blanks, as indicated by reference character 506. Blanking 506 includes separating the stock material along a plurality of severance lines separating between the blanks, e.g., severance lines 26, 28, and 29, wherein at least two of the severance lines are separated from one another by an offset void left from the stripped away portion of the stock material. This includes breaking the nicks left in the cutting 502.

Blanking 506 can include separating the stock material along a plurality of severance lines dividing the blanks from one another along a blanking grid, e.g., blanking grid 203. The blanking grid can be arranged in a nested sheet-fed layout as described above.

Figure 9:
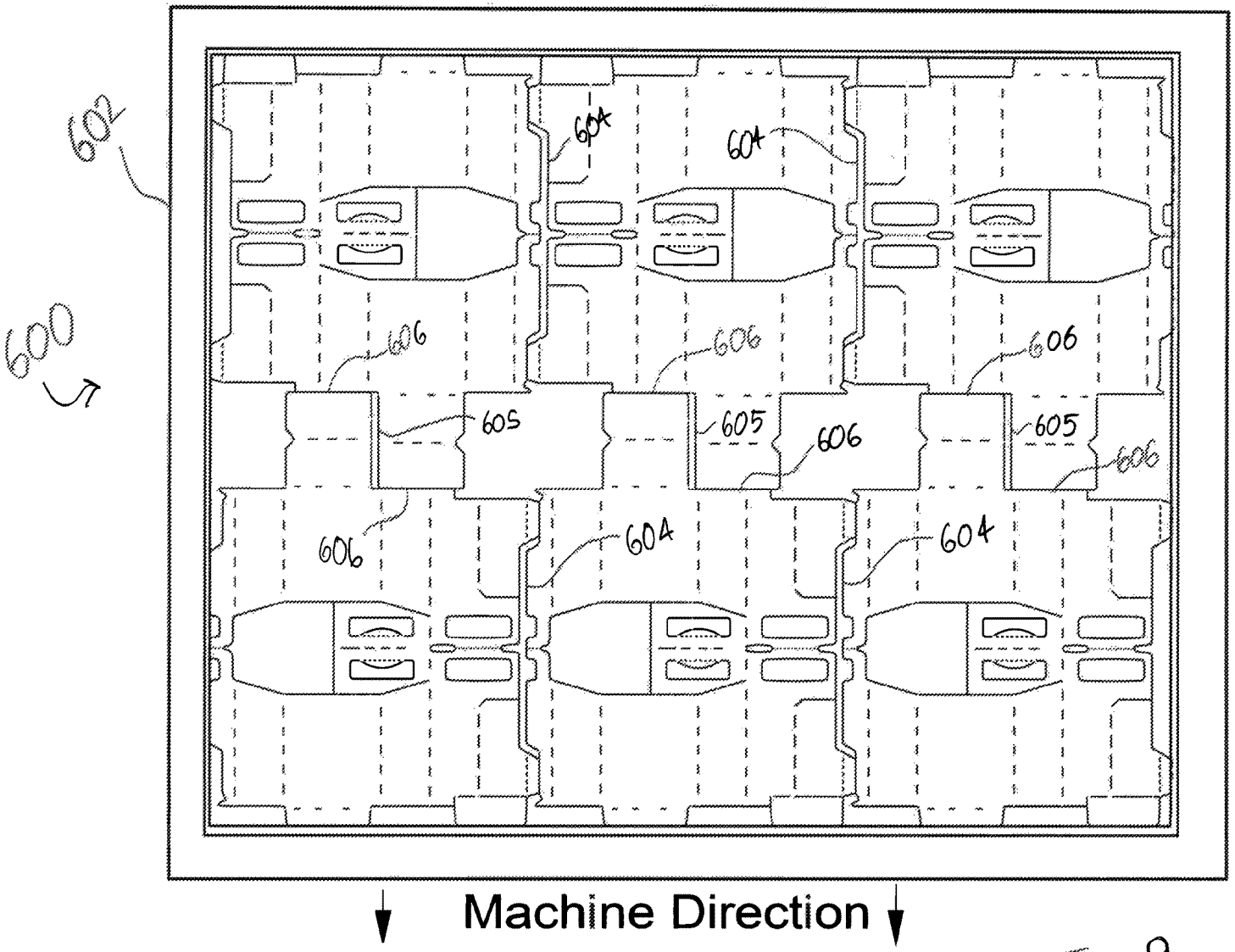
FIG. 9 is a schematic plan view of an exemplary embodiment of a cutting die, showing the cutting blades for forming offset voids and severance lines.

With reference now to FIG. 8, an exemplary cutting die 600 is described, which corresponds to the array of blanks 100 of FIG. 2, that can be used for the cutting 502 described above. Cutting die 600 includes a cutting die base 602 and a plurality of cutting blades 604 and 606 mounted to the cutting die base. The cutting blades 604 and 606 are arranged to cut an array of packaging blanks nested in a sheet-fed layout as described above. Cutting blades 604 define offset voids for cutting offset voids, e.g., offset voids 24 of FIG. 2, separating between two packaging blanks. Cutting blades 605 are included for cutting the offset voids, e.g., offset voids 25 of FIG. 2. The cutting die 600 also includes cutting blades 606 for cutting severance lines, e.g., severance lines 26, 28, and 29 of FIGS. 1 and 2. Other cutting blades not identified with reference characters in FIG. 9 are shown in solid lines, and scoring blades for forming folding lines, e.g. fold lines 30 of FIG. 1, are shown in broken lines in FIG. 9.

The methods and systems of the present disclosure, as described above and shown in the drawings, provide for nested blank configurations with superior properties including reduced scrap and reduced or eliminated risk of tearing during blanking. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a packaging container, the blank comprising a plurality of panels for forming the container, the plurality of panels including a first side panel, a first end panel, a bottom panel and a riser panel, the first side panel comprising first and second opposed end edges and a lower edge, the first end panel being connected by a fold line to the first end edge of the first side panel, the riser panel being connected by a fold line to the first end panel, wherein the bottom panel is connected by a fold line to the lower edge of the first side panel such that first and second opposed end edges of the bottom panel are located next to the first and second end edges of the first side panel respectively, wherein the plurality of panels further includes a second end panel connected by a fold line to the second end edge of the first side panel, and wherein the bottom panel is not symmetrically centered relative to the first side panel such that the bottom panel is disposed closer to the first end panel than to the second end panel, wherein the first side panel has a width defined between said first and second opposed end edges of the first side panel, wherein the bottom panel has a width defined between said first and second opposed end edges of the bottom panel, wherein the width of the bottom panel is less than the width of the first side panel, wherein the bottom panel is free of connection to any other part of the blank other than the first side panel.

2. A blank according to claim 1 wherein the bottom panel is disposed closer to the first end edge of the first side panel than to the second end edge of the first side panel.

3. A blank according to claim 1 wherein the first end edge of the bottom panel is closer to the riser panel than the second end edge of the bottom panel.

4. A blank according to claim 1 wherein the bottom panel is not symmetrically centered relative to the first side panel such that the bottom panel is connected to a first part of the lower edge of the first side panel, the first part of the lower edge being closer to the first end edge of the first side panel than to the second end edge of the first side panel.

5. A blank according to claim 4 wherein the lower edge of the first side panel has a second part which is free of any connection to any other part of the blank.

6. A blank according to claim 1, wherein the plurality of panels further includes a primary partition panel connected by a fold line to the second end panel.

7. A blank according to claim 6 wherein the plurality of panels further includes a lateral partition panel connected by a fold line to the primary partition panel.

8. A blank according to claim 6 wherein the riser panel is adhered to the primary partition panel when the blank is set up into the container.

9. A blank according to claim 6 wherein the plurality of panels further includes a handle panel connected to the primary partition panel and wherein the primary partition panel has a handle opening.

10. A packaging container comprising a plurality of panels defining an interior volume for receiving articles, including first and second side panels, first and second end panels and a bottom panel, the packaging container further comprising a riser panel, wherein the first side panel comprises first and second opposed end edges and a lower edge, the first end panel being connected by a fold line to the first end edge of the first side panel, the second end panel being connected by a fold line to the second end edge of the first side panel, the riser panel being connected by a fold line to the first end panel, wherein the bottom panel is connected by a fold line to the lower edge of the first side panel such that first and second opposed end edges of the bottom panel are located next to the first and second end panels respectively, wherein the bottom panel is not symmetrically centered relative to the first side panel such that the bottom panel is disposed closer to the first end panel than to the second end panel, wherein the first side panel has a width defined between said first and second opposed end edges of the first side panel, wherein the bottom panel has a width defined between said first and second opposed end edges of the bottom panel, wherein the width of the bottom panel is less than the width of the first side panel, wherein the bottom panel is free of integral connection to any other part of the packaging container other than the first side panel.

11. A packaging container according to claim 10 wherein the first end edge of the bottom panel is closer to the riser panel than the second end edge of the bottom panel.

12. A packaging container according to claim 10 wherein the bottom panel is not symmetrically centered relative to the first side panel such that the bottom panel is connected to a first part of the lower edge of the first side panel, the first part of the lower edge being closer to the first end panel than to the second end panel.

13. A packaging container according to claim 12 wherein the lower edge of the first side panel has a second part which is free of any connection to any other part of the packaging container, and wherein the second part is disposed between the first part and the second end panel.

14. A packaging container according to claim 10 wherein the first side panel has a width defined as the distance between first and second end edges thereof, and wherein the bottom panel has a width defined as the distance between first and second opposed end edges thereof, and wherein the width of the bottom panel is less than the width of the first side panel.

15. A packaging container according to claim 10, further comprising a primary partition panel connected by a fold line to the second end panel and a lateral partition panel connected by a fold line to the primary partition panel.

16. A packaging container according to claim 15 wherein the riser panel is adhered to the primary partition panel.

17. A packaging container according to claim 15 further comprising a handle panel connected to the primary partition panel and wherein the primary partition panel has a handle opening.

* * * * *